US009021772B2

(12) United States Patent
Bedetti

(10) Patent No.: US 9,021,772 B2
(45) Date of Patent: May 5, 2015

(54) MACHINE AND METHOD FOR FILLING AND WEIGHING CAPSULES

(75) Inventor: Maurizio Bedetti, Imola (IT)

(73) Assignee: I.M.A. Industria Macchine Automatiche S.p.A. (IT)

( * ) Notice: Subject to any disclaimer, the term of this patent is extended or adjusted under 35 U.S.C. 154(b) by 907 days.

(21) Appl. No.: 13/129,012

(22) PCT Filed: Nov. 26, 2009

(86) PCT No.: PCT/IB2009/055367

§ 371 (c)(1),
(2), (4) Date: Jul. 13, 2011

(87) PCT Pub. No.: WO2010/061349

PCT Pub. Date: Jun. 3, 2010

(65) Prior Publication Data

US 2011/0259468 A1 Oct. 27, 2011

(30) Foreign Application Priority Data

Nov. 28, 2008 (IT) ..... BO2008A0720

(51) Int. Cl.
*A61J 3/07* (2006.01)

(52) U.S. Cl.
CPC ..... *A61J 3/074* (2013.01); *A61J 2200/74* (2013.01)

(58) Field of Classification Search
CPC ..... A61J 3/07; A61J 3/071; A61J 3/072; A61J 3/074; A61J 3/075; A61J 3/077; A61J 2200/74
USPC ..... 53/52, 53, 502, 503, 900, 560, 452, 53/454, 467, 485, 471, 281, 282; 141/83
See application file for complete search history.

(56) References Cited

U.S. PATENT DOCUMENTS

| | | | | |
|---|---|---|---|---|
| 4,343,130 | A * | 8/1982 | Facchini | 53/272 |
| 5,515,740 | A * | 5/1996 | Gamberini | 73/865.8 |
| 5,617,710 | A * | 4/1997 | Goossens et al. | 53/471 |
| 5,750,938 | A * | 5/1998 | De Caris et al. | 177/50 |
| 6,327,835 | B1 * | 12/2001 | Trebbi | 53/53 |
| 7,042,231 | B2 * | 5/2006 | Trebbi | 324/639 |
| 7,140,403 | B2 * | 11/2006 | Gamberini | 141/83 |

(Continued)

FOREIGN PATENT DOCUMENTS

| | | | |
|---|---|---|---|
| EP | 1582193 | A1 | 10/2005 |
| GB | 2269354 | A | 2/1994 |
| WO | 97/31244 | A1 | 8/1997 |

(Continued)

*Primary Examiner* — Stephen F Gerrity
(74) *Attorney, Agent, or Firm* — Laubscher, Spendlove & Laubscher, P.C.

(57) ABSTRACT

A machine for dosing a product in capsules, includes a rotating turret which has seats suitable for receiving empty capsules and a dosing device for dosing the product in the capsules. The machine further includes a feeding unit having a first weighing device for weighing empty capsules, a transfer arrangement for transferring empty capsules, when weighed, to predetermined seats of the turret for being filled with the product, a second weighing device for weighing capsules filled with the product, and a processing device connected to the first and second weighing device for receiving data relative to weights measured by the first and second weighing devices and for calculating for each capsule a difference between the weight measured before and the weight measured after filling. In this manner, a respective quantity of dosed product is calculated.

18 Claims, 8 Drawing Sheets

(56) References Cited

U.S. PATENT DOCUMENTS

| | | | | |
|---|---|---|---|---|
| 7,694,497 | B2 * | 4/2010 | Tagliavini et al. | 53/499 |
| 8,266,874 | B2 * | 9/2012 | Runft et al. | 53/432 |
| 2008/0105468 | A1 * | 5/2008 | Ragazzini et al. | 177/1 |
| 2010/0132313 | A1 * | 6/2010 | Trebbi | 53/471 |
| 2011/0277871 | A1 * | 11/2011 | Trebbi et al. | 141/1 |

FOREIGN PATENT DOCUMENTS

| | | | |
|---|---|---|---|
| WO | 2006/037518 | A1 | 4/2006 |
| WO | 2007/062947 | A1 | 6/2007 |

* cited by examiner 1
4
42
43
41
44
201
6
9
C
65
B
201
14
64
M
8
12
16a
16
33
7
17
201a
201b
11
13
5
15
13a
19
35
37
36
38
18

MACHINE AND METHOD FOR FILLING AND WEIGHING CAPSULES

BACKGROUND OF THE INVENTION

This application is a §371 National Stage of PCT International Application No. PCT/IB2009/055367 filed Nov. 26, 2009. PCT/IB2009/055367 claims priority to IT Application No. BO2008A000720 filed Nov. 28, 2008. The entire contents of these applications are incorporated herein by reference.

The present invention relates to machines and methods for filling capsules or similar elements with pharmaceutical products. In particular it refers to a filling machine of the single-turret type and comprises a weighing device that is suitable for determining the net weight of the capsules, i.e. the weight of the dosed product.

In the processes of filling capsules of hard gelatine with pharmaceutical products, for example products in liquid, powder, granular or tablet form, the use of weighing apparatuses or devices is known that are placed downstream of the filling machine to measure the weight of the dosed product inside the capsules.

It is necessary to check weight both in order to reject from production capsules that are not compliant because they contain a quantity of product outside the permitted dosing tolerance range and in order to correct possible excesses or defects in dosing the product, by acting in feedback manner on a filling unit of the machine.

In the pharmaceutical field especially, it is important to check that the quantity of product introduced into the single capsules is exactly what is requested, with very narrow tolerance ranges.

In the case of filling processes in which the weight of the capsules is considerably less than the weight of the product to be dosed—so-called "macrodoses"—the capsules are generally weighed only once at the end of dosing. As the weight of the empty capsules is known and contained within a preset tolerance range, which is indicated and guaranteed by the manufacturers of the capsules, it is possible, from the measurement of the weight of the filled capsule (gross weight) subtracting the known weight of the empty capsule (tare weight), calculating the weight of the dosed product (net weight) with a certain degree of accuracy.

In this case in fact, variations in the weight of the empty capsules are negligible and fully contained within the tolerance range for the dosed product.

BRIEF DESCRIPTION OF THE PRIOR ART

The weighing devices that perform this type of direct measurement comprise electronic scales, typically load cells on which the capsules have to be positioned for a suitable time.

Apparatuses further exist that enable the weight of the capsules to be measured indirectly, for example, by measuring other physical quantities or physical parameters of the latter, by suitable sensors (capacitive sensors, magnetic sensors, microwave sensors, . . . ).

In the filling processes in which the quantity of product to be dosed inside each capsule is very small, for example a few milligrams—so-called "microdoses"—and/or the tolerance range requested on the dosage of the product is very limited, the normal variations in weight of the empty capsules affect and influence in a substantial manner the measurement of the weight of the filled capsule. In fact, as the weight of the empty capsules is comparable to or greater than that of the dosed product, such variations in weight may be greater than the tolerance range provided for dosing. In this case, in order to determine with accuracy the net weight of a capsule, it is necessary to measure directly the net weight of the dosed contents or weigh the capsule before and after dosing and calculate the difference in weight of the dosed product.

U.S. Pat. No. 7,071,706 illustrates a device and a method for determining the net weight of capsules filled with product by using electromagnetic radiation originated by a microwave generator. This complex and expensive device has the drawback of being able to be used only with products that are compatible with the use of microwaves. In addition to that, calibrating the aforesaid device is very laborious and complex and requires qualified personnel.

Weighing systems are known that perform a statistical check of the net weight of the capsules, i.e. they check a small sample of the capsules.

U.S. Pat. No. 5,515,740 and U.S. Pat. No. 7,140,403 disclose filling machines that enable the net weight of capsules to be measured comprising a first weighing unit or scales, upstream of the filling unit, that measures the weight of a sample of empty capsules (tare) taken from a conveying carousel or wheel, and a second weighing unit, downstream of the filling unit, that measures the weight of said sample of filled capsules (gross weight), taken from a further conveying wheel. A processing unit calculates for each capsule of the sample the difference in the weight measured by the two weighing units and determines the net weight, i.e. the weight of the dosed product.

This solution is applicable only to filling machines of the type comprising a plurality of conveying wheels for conveying the capsules, that are positioned adjacent and in succession to one another. A respective operating unit that performs a specific operation on the capsules (feeding the capsules, weighing, filling, etc) is in fact associated with each conveying wheel.

The aforesaid solution is not thus usable in filling machines with a high production speed of the so-called rotating single-turret type. In this type of machine, a turret or carousel is provided comprising a plurality of operating stations in which, during the continuous rotation of the turret, all the capsule-processing steps are conducted in sequence. These filling machines, as they are devoid of conveying wheels for conveying the capsules, do not enable the capsules to be extracted from and subsequently inserted into the operating stations of the turret in order for the capsules to be weighed before and after they have been filled with product.

The weighing system disclosed in U.S. Pat. No. 5,515,740 and U.S. Pat. No. 7,140,403 is further difficult to apply also to filling machines comprising a rotating central turret provided with seats housing the capsules and feeding units and filling units positioned adjacent and peripherally to said turret. In this type of machine, the capsules are in fact housed and conveyed during all the processing steps by the same central turret, on the periphery of which there being positioned the aforesaid feeding and filling units. Also in this case, as there are no conveying wheels, it is not possible to extract the capsules from and subsequently insert the capsules into the central turret to weigh the capsules before and after filling.

SUMMARY OF THE INVENTION

An object of the present invention is to improve known machines and methods for filling capsules or similar elements with a product, in particular for pharmaceutical use, and for measuring the weight thereof.

Another object is to obtain a filling machine of the single-turret type that enables the net weight of a sample of capsules filled with product to be determined.

A still further object is to obtain a machine and a method that enable the capsules to be weighed precisely, before and after filling.

In a first aspect of the invention there is provided a machine for dosing a product in capsules, or similar elements, including a rotating turret arrangement which has seats suitable for receiving capsules drawn empty from a first store and a dosing device for dosing the product in the capsules. The machine also includes:

- a feeding unit having a first weighing device, for weighing further capsules drawn empty from a second store;
- a transfer arrangement for transferring the further capsules, when weighed, to predetermined seats of the turret arrangement for being filled with the product;
- a second weighing device for weighing the further capsules filled with the product and taken out from the turret arrangement; and
- a processing device connected to the first weighing device and to the second weighing device for receiving data relative to weights measured by the first and second weighing devices and for calculating for each further capsule a difference between a weight measured before and a weight measured after filling in such manner as to calculate a respective quantity of dosed product.

In particular the filling machine includes a single turret, which is rotatable around a rotation axis and provided with a plurality of operating stations, each of which is provided with a respective dosing device and configured for opening, dosing the product and closing respective capsules and further capsules during rotation of the turret.

In another embodiment of the machine, the turret arrangement includes a central turret, a feeding station, provided with the first store and at least a filling station provided with the dosing device, the feeding station and the filling station being arranged adjacent and peripherally to the turret.

The feeding unit includes a handling device for singly handling the further capsules from the second store to the second weighing device and from the latter to the transfer arrangement.

The transfer arrangement includes a wheel that is rotatable about a further rotation axis and provided with an arm having at a free end a housing suitable for receiving from the feeding unit a further capsule and releasing it to a predetermined seat of the turret arrangement. The arm is mounted axially movable on the wheel and is suitable to be operated towards or away from said further rotation axis depending on an angular position of the wheel in such a way that the housing of the arm moves along a trajectory, a portion of which substantially overlaps a respective rotation trajectory of the seats.

A stop arrangement is provided for selectively blocking the feeding of the capsules coming from the first store and preventing the capsules from being inserted into the predetermined seats of the turret arrangement, the predetermined seats thus remaining empty for receiving from the transfer arrangement respective further capsules.

A separation element is provided adjacent to the turret arrangement for receiving the capsules and the further capsules once the capsules and further capsules have been filled with product and removed from the turret arrangement, and respectively conveying the capsules to a collection store and the further capsules to the second weighing device.

In a second aspect of the invention there is provided a method for weighing a product dosed in capsules or similar elements by a filling machine which includes a rotating turret arrangement which has seats suitable for receiving empty capsules from a first store and a dosing device for dosing the product into the capsules. The method includes:

- keeping predetermined seats of the turret arrangement empty;
- inserting respective further empty capsules from a second store and weighed by the first weighing device in the empty predetermined seats;
- opening the capsules, dosing the product and closing the capsules and the further capsules;
- using a second weighing device to weigh the further capsules once removed from the turret arrangement; and
- calculating for each further capsule a difference between a weight measured before and a weight measured after filling in such a way as to determine a respective quantity of dosed product.

Owing to these aspects of the invention it is possible to obtain a machine and a method for filling capsules or similar elements with a product, and performing a statistical checkof the net weight of said capsules, this check being particularly suitable in the case of dosing processes in which the quantity of product to be dosed inside each capsule is very small and such that normal variations in the weight of the empty capsules are comparable to or greater than the weight of the dosed product.

As a result of the configuration of the feeding unit and transfer arrangement it is possible to check the net weight of a preset sample of capsules without reducing in any manner the production speed of the filling machine and without performing interventions on or making substantial modifications to the structure of the machine. It is in fact sufficient for the stop arrangement to create in the turret arrangement, during rotation thereof, predetermined empty seats in which the transfer arrangement can insert respective further capsules previously weighed. It is possible to leave the seats empty according to a preset sequence, or a random selection. During the operating cycle of the filling machine all the seats, i.e. all the operating stations are intended for receiving respective further capsules several times. In this manner, by measuring the weight of the dosed product, it is possible to check the correct and regular operation of the dosing device associated with each operating station, i.e. with each seat.

BRIEF DESCRIPTION OF THE FIGURES

The invention can be better understood and implemented with reference to the attached drawings that illustrate some embodiments thereof by way of non-limiting example, in which.

DETAILED DESCRIPTION

Figure 1:
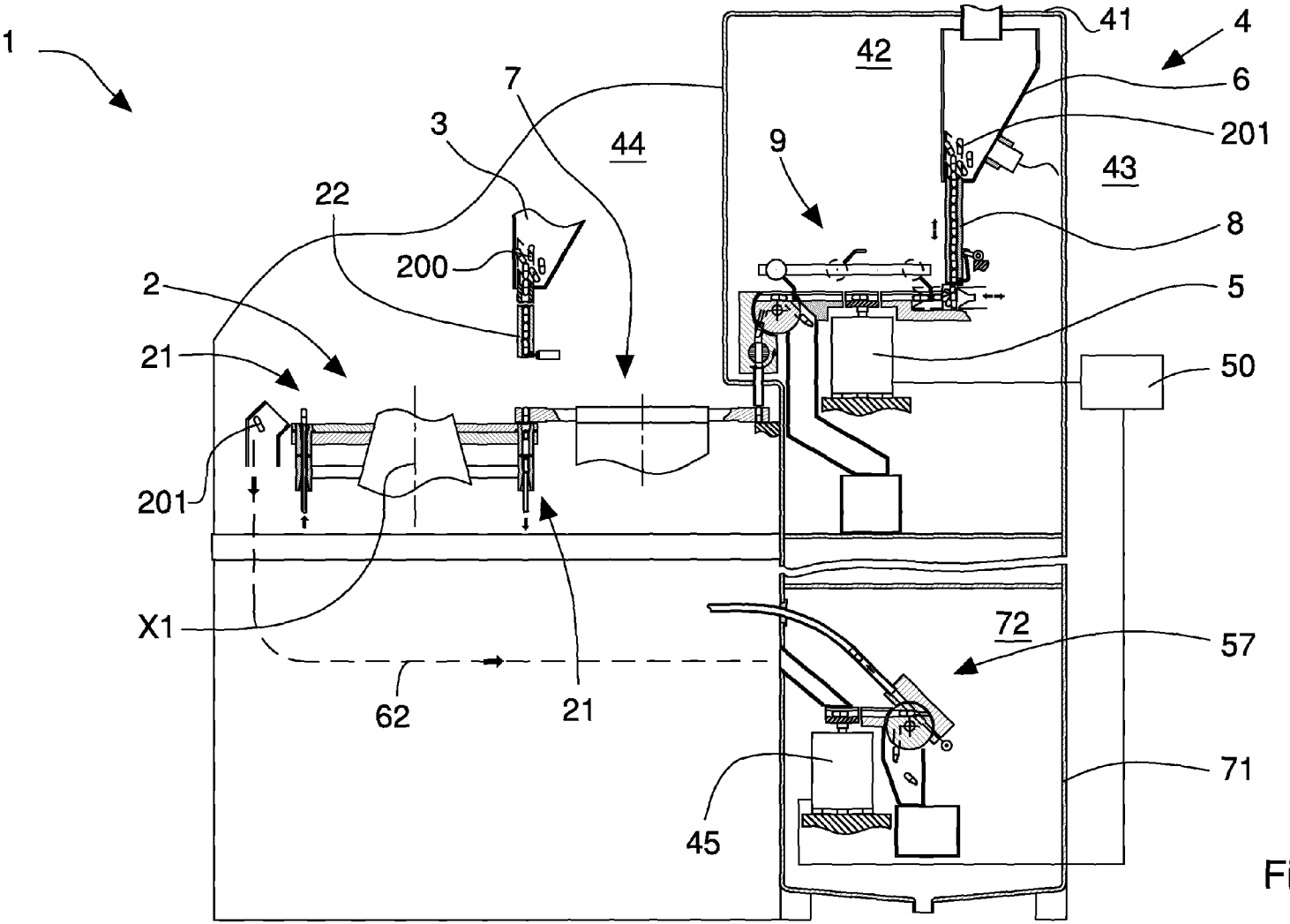
FIG. 1 is a schematic and partial section view of a machine for filling capsules according to the invention.

With reference to FIGS. 1 to 7, there is illustrated a filling machine 1 for dosing a product, for example in powder, liquid or granular form, inside capsules 200 or similar elements, in particular capsules of hard gelatine.

The machine 1 is provided with a turret arrangement 2, of known type and not illustrated in detail in the figures, including a single operating turret that is rotatable about a vertical rotation axis X1, and includes a plurality of operating stations 21, each of which is suitable for processing, i.e. performing a series of operations on capsules 200 drawn empty from a first store 3, which is also supported by the turret 2.

In the operating stations 21 all the steps of processing the capsules 200 are performed, in sequence, during rotation of the turret 2 with continuous motion. The empty capsules 200 from the first store 3 reach the operating stations 21 via respective feeding ducts 22. In the operating stations 21 the capsules 200 are in sequence oriented, opened, filled with product, closed and finally taken out and conveyed to the outlet of a collection store 23.

With each operating station 21 a respective dosing device is associated that is of known and non-illustrated type that doses a preset quantity of product inside the capsules.

Each feeding duct 22 enables one capsule 200 at a time to be inserted inside a respective seat 24 of the corresponding operating station 21. In the seat 24 the capsule is opened, i.e. a bottom of the capsule is separated from a respective lid or top and transferred by suction to a further seat 25 of a movable support 26 of the turret 2. The movable support 26 moves the bottom of the capsule 200 relative to the dosing device to enable it to be filled with the product.

A stop arrangement 30 is provided for blocking the displacement of the capsules 200 along the feeding ducts 22 of the turret 2 and preventing the capsules 200 from being inserted in the seats 24, which thus remain empty. The absence of the capsule 200 to be processed inhibits the operation of an operating station or excludes an operating station from operating.

The stop arrangement 30 includes a plurality of movable abutting elements 31, each of which is associated with a respective feeding duct 22 and suitable for operation by a corresponding actuator 32 between two operating positions, so as to block or allow the passage of the capsule 200. Each actuator 32 includes, for example, a single or double-acting pneumatic cylinder or a linear electric motor.

The abutting elements 31 and the respective actuators 32 are controlled separately and independently by a control unit that manages and commands operation of the entire filling machine 1. In this manner, it is possible to leave seats 24 empty and inhibit the operation of the operating stations 21 according to a fixed sequence, or with a random selection, as explained in detail below in the description.

The machine 1 includes a feeding unit 4 arranged adjacent to the turret arrangement 2 and provided with a first weighing device 5 suitable for weighing further empty capsules 201 from a second store 6 by a further feeding duct 8.

The further capsules 201 are identical to the capsules 200 and come, for example, from the same production batch. In other words, the further capsules 201 have the same physical features (dimensions, weight and tolerance) as the capsules 200.

A handling device 9 is provided for orienting and handling singly the further capsules 201 from the further feeding duct 8 to the second weighing arrangement 5 and from the latter to the transfer arrangement 7, which transfers the further capsules 201, which have been weighed, from the feeding unit 4 to the turret arrangement 2.

Figure 2:
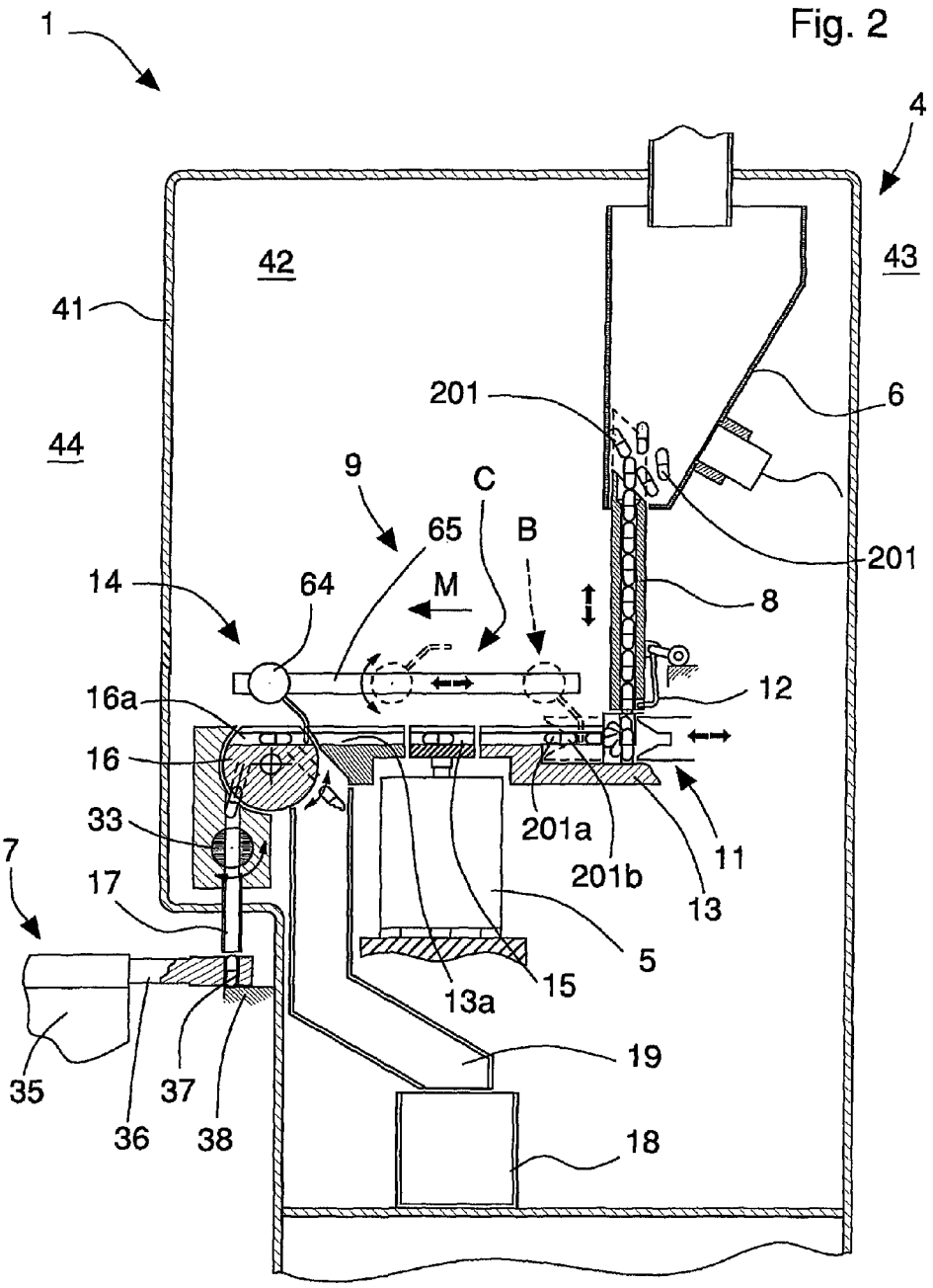
FIG. 2 is an enlarged detail of FIG. 1, showing a feeding unit for feeding further empty capsules.

As illustrated in detail in FIG. 2, the handling device 9 includes an orienting element 11, which is of known type and is not illustrated in detail, that rotates and places the further capsules 201 in a horizontal position that a movable and suitably operatable abutting element 12 enables the further capsules to exit one at a time from the further feeding duct 8.

The orienting element 11 is arranged for orienting each further capsule 201 so that the respective bottom 201*a* faces in the direction of the first weighing device 5.

A first guide 13 is provided for slidingly supporting the further capsule 201 along an advancement direction M. The first guide 13 includes a linear groove 13*a* in which the further capsules 201 are received and slide.

The first guide 13 is interrupted at a support or pan 15 of the first weighing device 5, which includes, for example, a single weighing cell scale, which is separated and insulated from the machine 1 in order to ensure precise and repeatable measuring.

The machine 1 includes a processing device 50 connected to the first weighing device 5 for receiving, storing and managing data relating to the measured weight of the further empty capsules 201.

The processing device 50 can be integrated into the control unit of the machine 1 or constitute a separate unit.

The handling device 9 further includes an advancement arrangement 14 arranged for handling each further capsule 201 along the groove 13*a* from the orienting element 11 to the pan 15 and from the latter to a selection member 16.

The selection member 16 selectively conveys to the transfer arrangement 7 further capsules 201 that are dosed and/or within an accepted weight tolerance, or to a first rejection store 18 further capsules 201 that are damaged and/or have a weight outside of an accepted tolerance.

The advancement arrangement 14 includes, in particular, at least a dragging element 64 that is movable between an operating position B, in which it abuts a further capsule 201 to be handled and a disengagement position C in which it is detached from the further capsule 201, for example to enable the first weighing device 5 to weigh the further capsule 201.

The dragging element 64 is rotatably and slidably fixed to a supporting element 65 so as to be movable along the advancement direction M to displace each further capsule 201 as disclosed in further detail in the description. An operating device, which is of known type and is not illustrated in the figures, is provided for rotating the dragging element 64 between the operating position B and the disengagement position C and moving it linearly in the advancement direction M in both directions.

The first selection member 16 includes, for example, a first wheel that is rotatable about a horizontal axis and is provided with a first cavity 16*a* arranged for receiving from the first guide 13 the further capsule 201 once weighed.

If the further capsule 201 is dosed and/or within an accepted weight tolerance, the first wheel 16 is rotated, for example anticlockwise, so as to convey through gravity the further capsule 201 to the transfer arrangement 7, via an insertion duct 17.

Otherwise, if the further capsule 201 is damaged and/or with a weight out of tolerance, the first wheel 16 is rotated in the opposite direction, for example clockwise, so as to convey the further capsule 201 to a first rejection store 18, by a first elimination duct 19.

A sensor, of known type and not illustrated in the figures, checks the integrity of the further capsules 201 during transferring from the second store 6 to the first selection member 16.

The feeding unit 4 has a covering element 41 that defines an internal volume or space 42, in which are positioned the second store 6, the handling device 9, the first weighing device 5, the first selection member 16, the first rejection store 18 and the first elimination duct 19. The aforesaid internal volume 42 can be separated, possibly sealed, from an external environment 43 in which the machine 1 is located and/or from a processing volume 44 defined by a respective covering element of the machine 1 and in which at least the turret arrangement 2 and the transfer arrangement 7 are located.

The insertion duct 17 traverses the covering element 41 and enables the further capsule 201 to be deposited inside a housing located on the transfer arrangement 7.

A valve 33 can close or open the insertion duct 17 and isolate, or put in communication, the internal volume 42 from/with said processing volume 44.

With particular reference to FIGS. 3 to 6, the transfer arrangement 7 substantially includes a transfer wheel or carousel 35 rotating about a further rotation axis X2 and an arm 36 provided at a free end of a through housing 37 suitable for receiving a further capsule 201. The housing 37 has a substantially cylindrical shape with a diameter that is slightly greater than that of the further capsule 201. A sliding guide 38 supports the further capsule 201 and prevents the further capsule 201 from exiting the housing 37 during rotation of the transfer wheel 35.

The arm 36 is movable axially, in particular along a radial direction, and operated towards or away from the further rotation axis X2, depending on an angular position of the transfer wheel 35, in such a manner as to move the housing 37—and thus the further capsule 201 housed therein—along a motion trajectory P an arched portion P1 of which is overlapped on a respective circular motion trajectory S along which the seats 24 of the turret 2 move. In particular, the arm 36 is movable between a retracted position R in which it receives the further capsule 201 from the insertion duct 17 and a plurality of extended positions in which it intercepts and overlaps the motion trajectory S of the seats 24.

The length of the arched portion P1, to which corresponds a respective angular size $\alpha$ along which the transfer wheel 35 travels, is such as to enable the further capsule 201 to be transferred to a respective seat 24, the latter left suitably empty, preventing a capsule 200 from descending from the corresponding feeding duct 22. In other words, the wideness of the portion P1 in combination with a rotation speed of the turret 2 ensures an overlap time of the two trajectories P, S that is sufficient to enable the further capsules 201 to be transferred correctly.

The arm 36 is operated in phase with the rotation of the transfer turret 35, for example, by a cam kinematic motion that is of known type and is not illustrated in detail in the figures.

Figure 6:
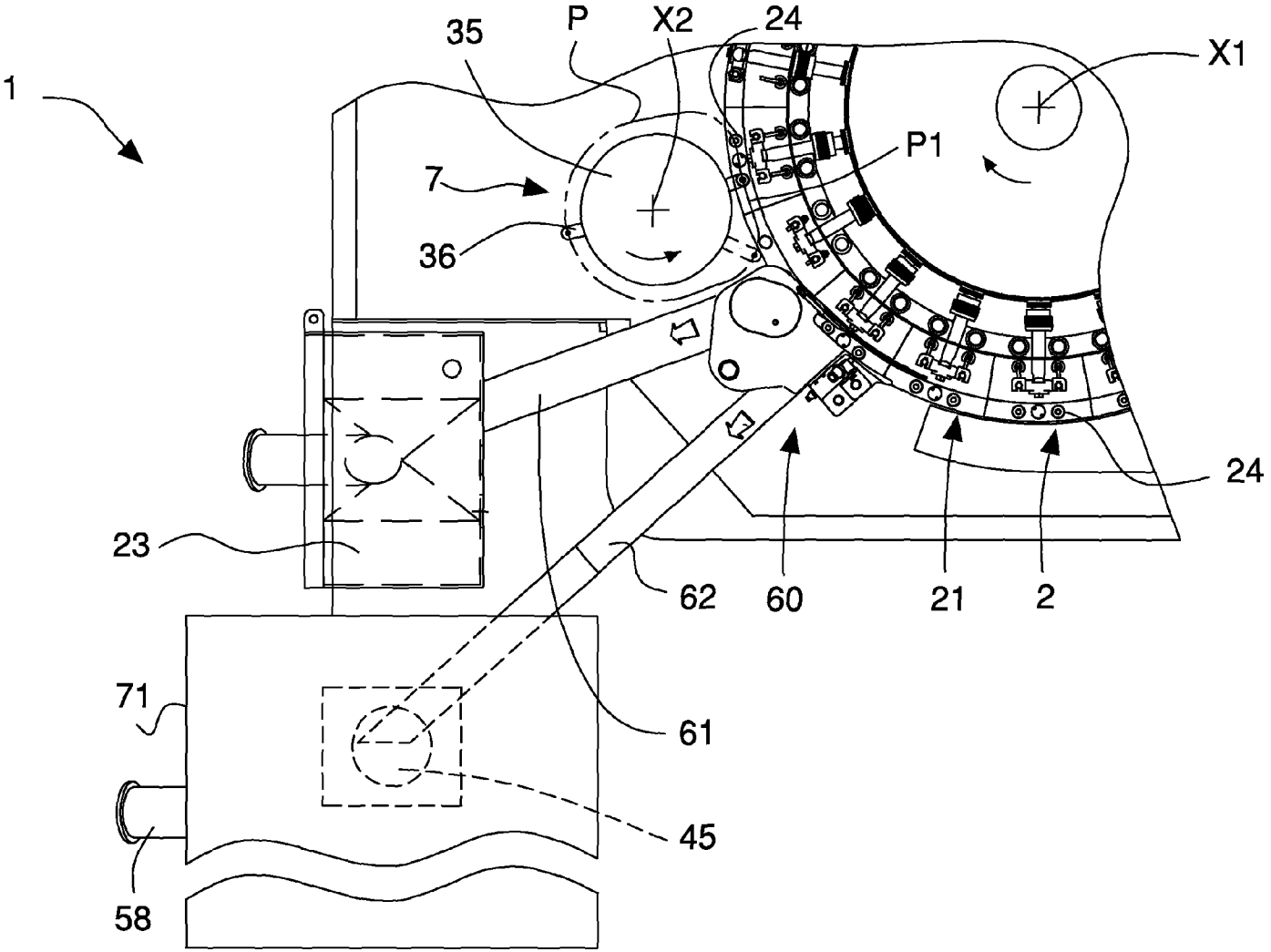
FIG. 6 is a partial plan view of the machine in FIG. 1, showing a separation element and a second weighing device of further filled capsules.
Figure 7:
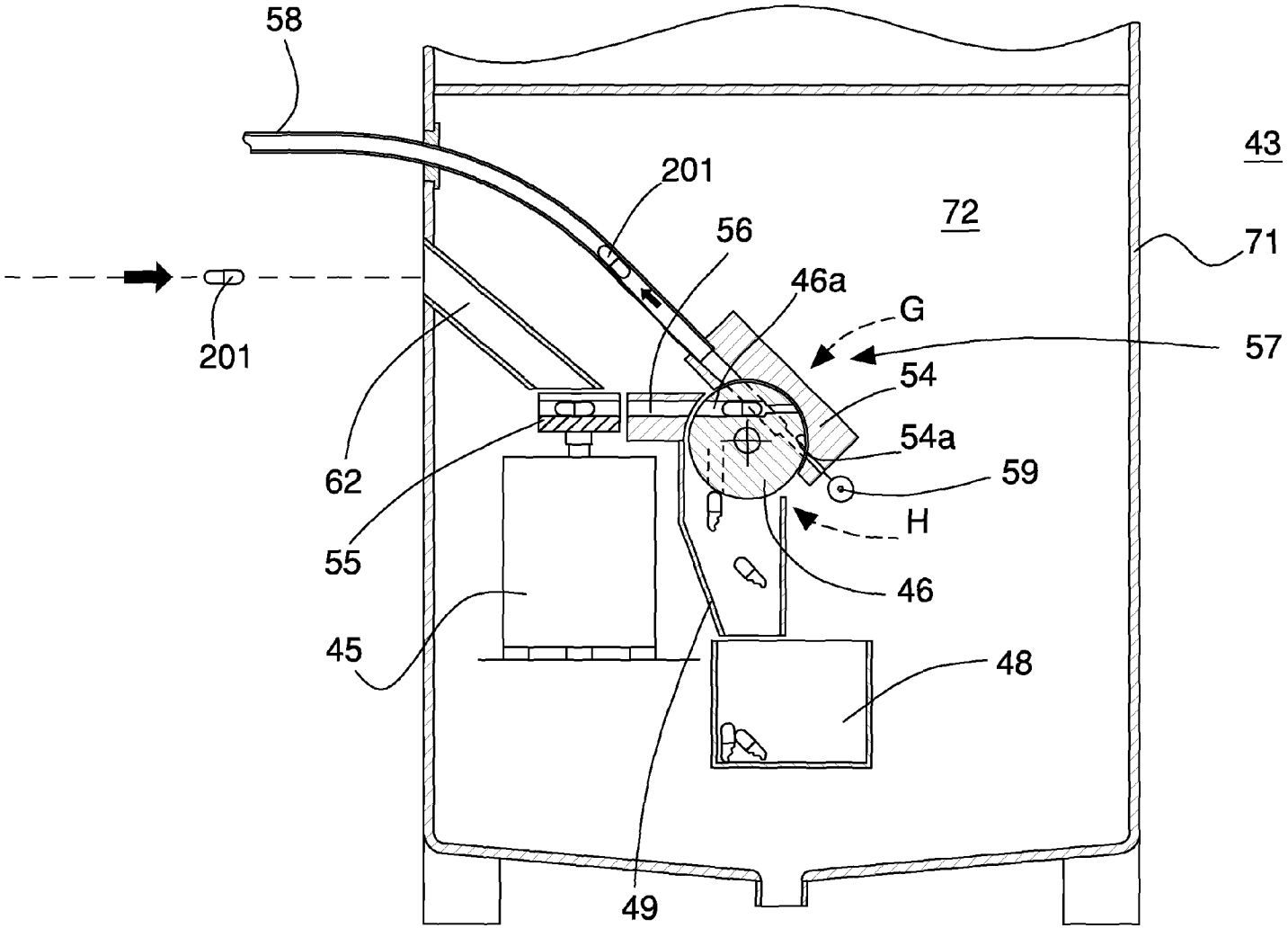
FIG. 7 is a further enlarged detail of FIG. 1, illustrating the second weighing device.

With particular reference to FIGS. 6 and 7, the machine 1 of the invention includes a second weighing device 45 for weighing the further capsules 201 once filled with product and removed from the turret 2.

The processing device 50 is connected to the second weighing device 45 for receiving, storing and managing data relating to the measured weight of the filled further capsules 201. In this manner, the processing device 50 is able to calculate for each further capsule 201 a difference between the weight measured before and after filling so as to determine the net weight i.e. a respective quantity of dosed product. This provides the opportunity to check the precision and repeatability of the dosing device associated with the operating station 21 that has processed the further capsule 201.

Figure 3:
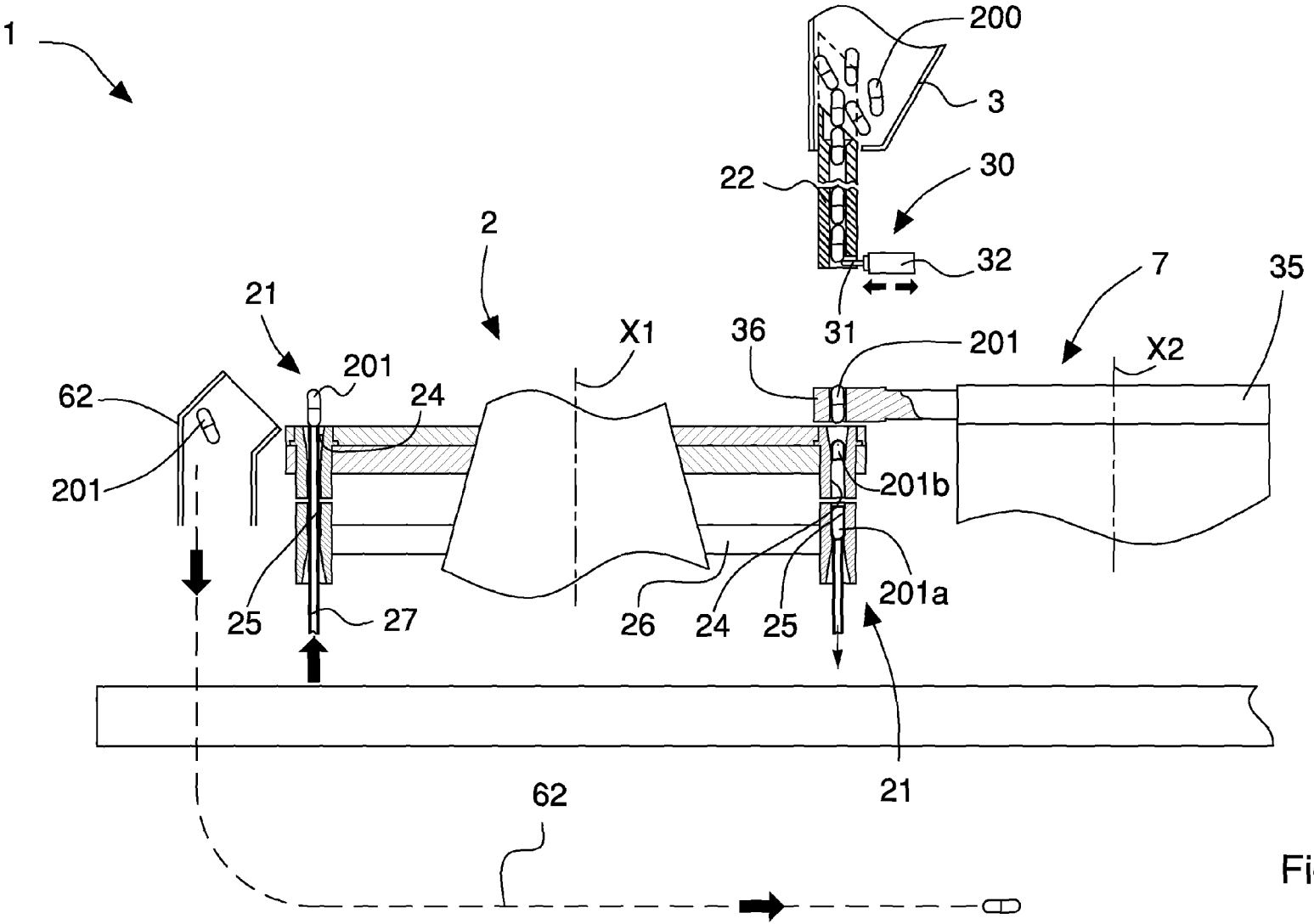
FIG. 3 is another enlarged detail of FIG. 1, showing a transfer arrangement for transferring the empty capsules and the turret arrangement.
Figure 4:
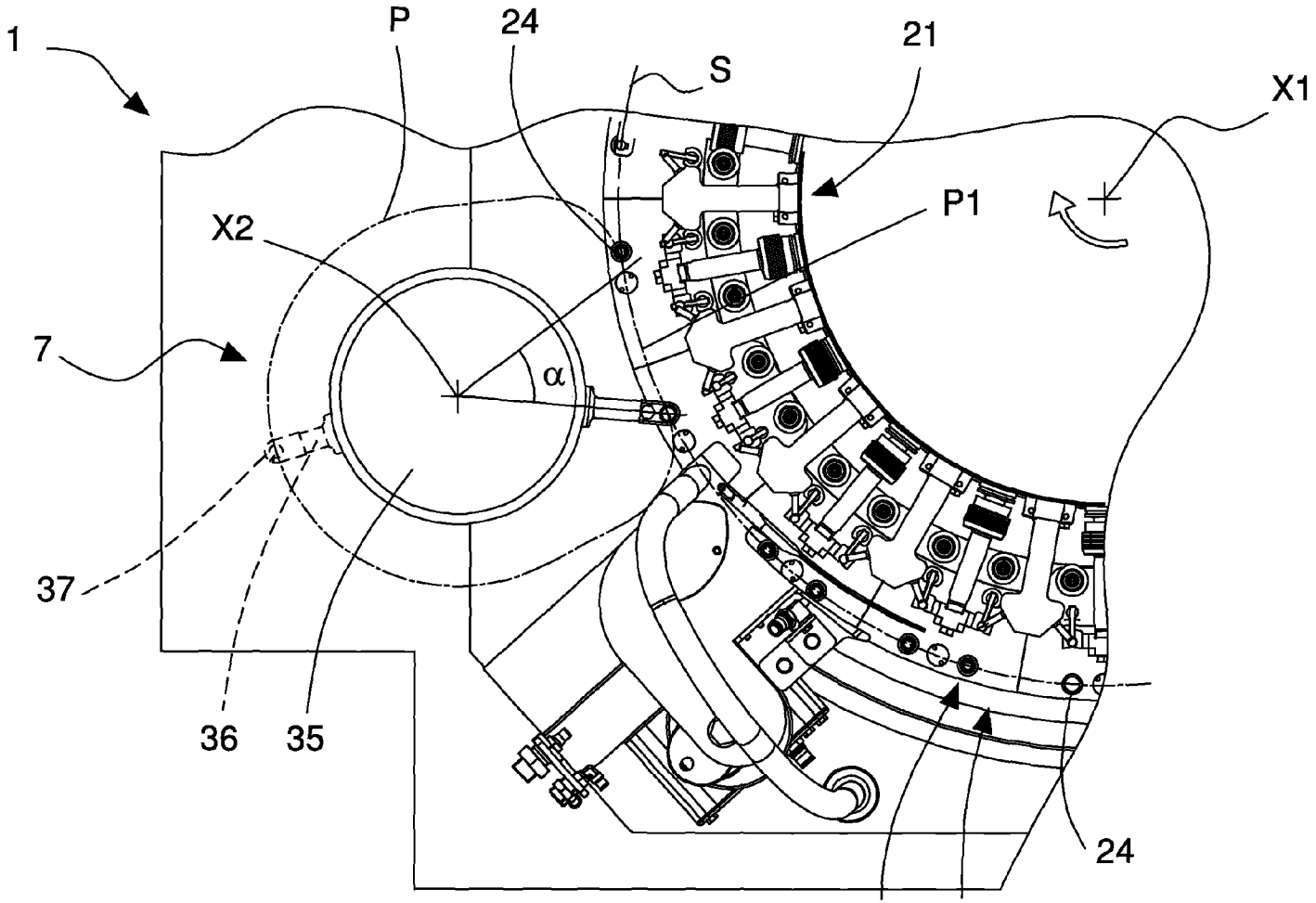
FIG. 4 is a partial plan view of the machine in FIG. 1, showing the transfer arrangement and the turret arrangement.
Figure 5:
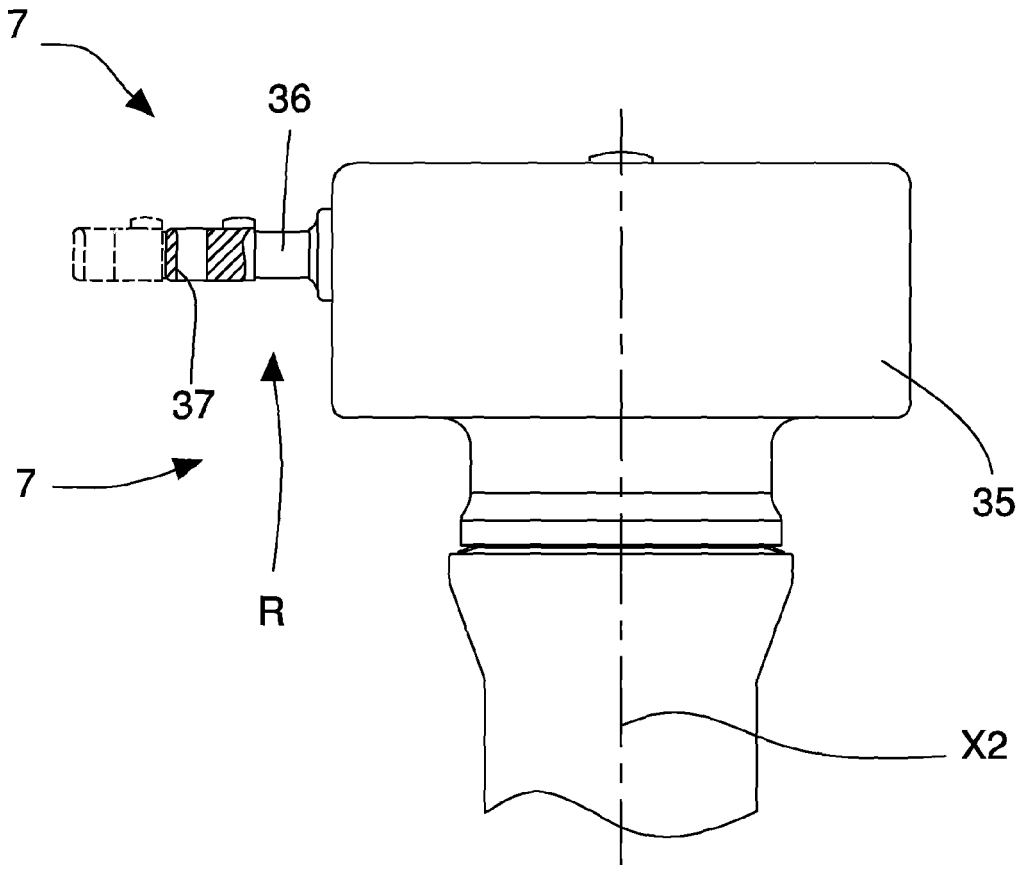
FIG. 5 is a partial side view of the transfer arrangement with an arm in a retracted position and, represented by a dashed line, in an extended position.

A separation element 60 is positioned adjacent to the turret 2 for receiving the capsules 200, 201, filled and closed, which are removed from the turret 2. In particular, the step of removing the capsules 200, 201 occurs at a defined angular position of the turret 2, in which an ejection element 27 of each operating station 21 pushes upwards, outside the respective seats 24, 25, the capsules 200, 201 housed therein (FIG. 3).

The separation element 60 is arranged for conveying the capsules 200 to the collection store 23, by an outlet duct 61, and the further capsules 201 to the second weighing device 45, by a transfer duct 62, respectively.

The separation element 60 includes, for example, nozzles from which a pressurized fluid exits, typically compressed air, that is able to divert to the transfer duct 62 only the further capsules 201.

The separation element 60 is commanded by the control unit of the machine 1, or by the processing device 50, which is able to store at each rotation of the turret 2 which operating station 21, i.e. which seat 24, has received from the transfer arrangement 7 a further capsule 201 from the feeding unit 4 rather than a capsule 200 from the first store 3. When the further capsule 201 is removed from this seat 24, the control unit commands the separation element 60 to be operated in order to direct the aforesaid further capsule 201 to the second weighing device 45.

The latter is substantially similar to the first weighing device 5 and comprises a respective pan 55 that is shaped so as to house a further capsule 201, oriented in a horizontal position, coming from the transfer duct 62.

A further advancement arrangement, similar to the advancement arrangement 14 of the feeding unit 4, is provided for displacing each further capsule 201 from the pan 55 to a second selection member 46, through a second guide 56.

Alternatively, the further advancement arrangement may include one or more nozzles arranged for emitting jets of pressurised fluid, typically compressed air, that are able to displace the further capsule 201 along the second guide 56.

The second selection member 46 is provided for selectively conveying to a movement arrangement 57 further capsules 201 that are dosed and/or within a weight tolerance, or to a second rejection store 48 further capsules 201 that are damaged and/or outside an accepted weight tolerance.

The second selection member 46 includes, for example, a second wheel, that is rotatable about a horizontal axis, which has a second cavity 46*a* for receiving from the second guide 56 the further capsule 201 once it has been weighed.

If the further capsule 201 is dosed and/or within an accepted weight tolerance, the second selection wheel 46 is rotated, for example clockwise, in a delivery position G so as to enable the movement arrangement 57 to eject the further capsule 201 from the second cavity 46*a* and to displace the further capsule 201 outwards, for example to the collection store 23.

The movement arrangement 57 includes a main body 54 provided with a shaped seat 54*a* arranged for partially receiving the second wheel 46 and connected, by respective opposite passages, to a displacement duct 58 and to a source 59 of pressurised fluid, typically compressed air.

In the delivery position G of the second wheel 46, the second cavity 46*a* is substantially connected to the displacement duct 58 and to the source 59. In this manner, the pressurised fluid coming from the aforesaid source 59 is able to push the further capsule 201 along the displacement duct 58 up to the collection store 23.

If the further capsule 201 is damaged and/or with a weight out of tolerance, the second selection wheel 46 is rotated in an opposite direction, for example anticlockwise, to a rejection position H, in such a way as to convey the further capsule 201 to the second rejection store 48 by a second elimination duct 49.

A second covering element 71 is provided for defining a respective internal volume 72, in which are positioned the second weighing device 45, the further advancement arrangement, the second guide 56, the second selection member 46, the movement arrangement 57, the second rejection store 48 and the second elimination duct 49.

The internal volume 72 of the second covering element 71 can be separated, possibly sealed, from the external environment 43 and/or from the processing volume 44.

During the operating cycle of the filling machine 1 of the invention the abutting elements 31 of the stop arrangement 30 are operated according to a fixed sequence or by random selection to stop the descent of capsules 200 along the feeding ducts 22 of respective operating stations 21 of the turret 2. In this manner, in the operating stations 21, the seats 24 remain empty and it is possible to insert therein respective further capsules 201 fed by the feeding unit 4.

In the feeding unit 4 the orienting element 11 rotates and places the further capsules 201 in a horizontal position and the stop element 12 allows the further capsules 201 to exit one at a time from the further feeding duct 8.

After exiting the orienting element 11 each further capsule 201 is transferred from the advancement arrangement 14 to the pan 15 of the first weighing device 5.

Once the weight of the further empty capsule 201, i.e. the tare weight, has been measured, the selection member 16 displaces the further capsule 201 on the first selection wheel 16 then returns to the orienting element 11 to draw a subsequent further capsule 201.

If the further capsule 201 is dosed and/or within an accepted weight tolerance, the first wheel 16 is rotated so as to convey through gravity the further capsule 201 to the transfer arrangement 7, by the insertion duct 17. In particular, the further capsule 201 is inserted in the housing 37 of the arm 36 of the transfer carousel 35.

Once the further capsule 201 is received in the transfer arrangement 7, the transfer carousel 35 is activated. The combination of the rotation of the transfer carousel 35 and the radial displacement of the arm 36 enables the housing 37 and thus the further capsule 201 contained therein to be displaced, with the motion trajectory P that overlaps along the portion P1 on the circular trajectory S of the seats 24 of the turret 2. In this manner, the seat 37 of the arm 36 displaces substantially overlapped on a predefined seat 24 for an interval of time that is sufficient for the further capsule 201 to descend in seat 24. The latter is transferred through gravity and/or by virtue of suction into the further seat 25, in which the capsule is opened.

The further capsule 201 transferred in the respective operating station 21 is subjected to the successive steps of opening, filling with product, closing and ejecting in the same manner as the capsules 200.

Once the further capsule 201 has been removed from the respective operating station 21, it is received by the separation element 60, which conveys the further capsule 201 to the second weighing device 45, by the transfer duct 62.

The second weighing device 45 measures the weight of the further capsule 201 filled with product (gross weight) and communicates the weight to the processing device 50. The processing device 50 subtracts from this gross weight the empty (tare) weight of the further capsule 201, which was previously measured by the first weighing device 5, and calculates the weight of the dosed product, arriving at the net weight.

The filling machine 1 of the invention thus enables a statistical check of the net weight of the capsules to be conducted that is particularly suitable in the case of dosing processes in which the quantity of product to be dosed inside each capsule is very small and such that the normal variations in the weight of the empty capsules are comparable to or greater than the weight of the dosed product.

As a result of the configuration of the feeding unit 4 and of the transfer arrangement 7 it is possible to check the net weight of a preset sample of capsules without reducing the production speed of the filling machine 1 and without conducting substantial interventions on or modifications to the structure of the latter. It is in fact sufficient for the stop arrangement 30 to create in the turret 2, during rotation thereof, predefined empty seats 24 in which the transfer arrangement 7 can insert respective further capsules 201, previously weighed. It is possible to leave the seats 24 empty according to a fixed sequence, or a random selection. During the operating cycle of the filling machine all the seats 24, i.e. all the operating stations 21, are intended to receive further capsules 201 several times. In this manner, by measuring the weight of the dosed product, it is possible to check the correct and regular operation of the dosing device associated with each operating station 21, i.e. with each seat 24.

It should be noted that by stopping the descent of the capsules 200 coming from the first store 3 along one or more feeding ducts 22 with the driving of the respective abutting elements 31, it is possible to inhibit or exclude from operation the corresponding operating stations 21.

It may be necessary to exclude an operating station 2 from operating 1 during operation of the machine 1, for example, if the dosing device associated therewith conducts filling out of tolerance, verified by the processing device 50 by the weighing devices 5, 45.

The exclusion may also be necessary in the event of malfunction or fault of other operating devices of the operating station 21.

In the case of malfunction of one or more operating stations, the filling machine 1 can continue production without having to stop. This opportunity is advantageous if the pharmaceutical product to be dosed is expensive and particularly difficult to be processed.

Excluding the operating stations 21 is also applicable during the steps of calibrating and setting up the machine 1 in order to limit the number of capsules and the quantity of product to be used for the test.

Figure 8:
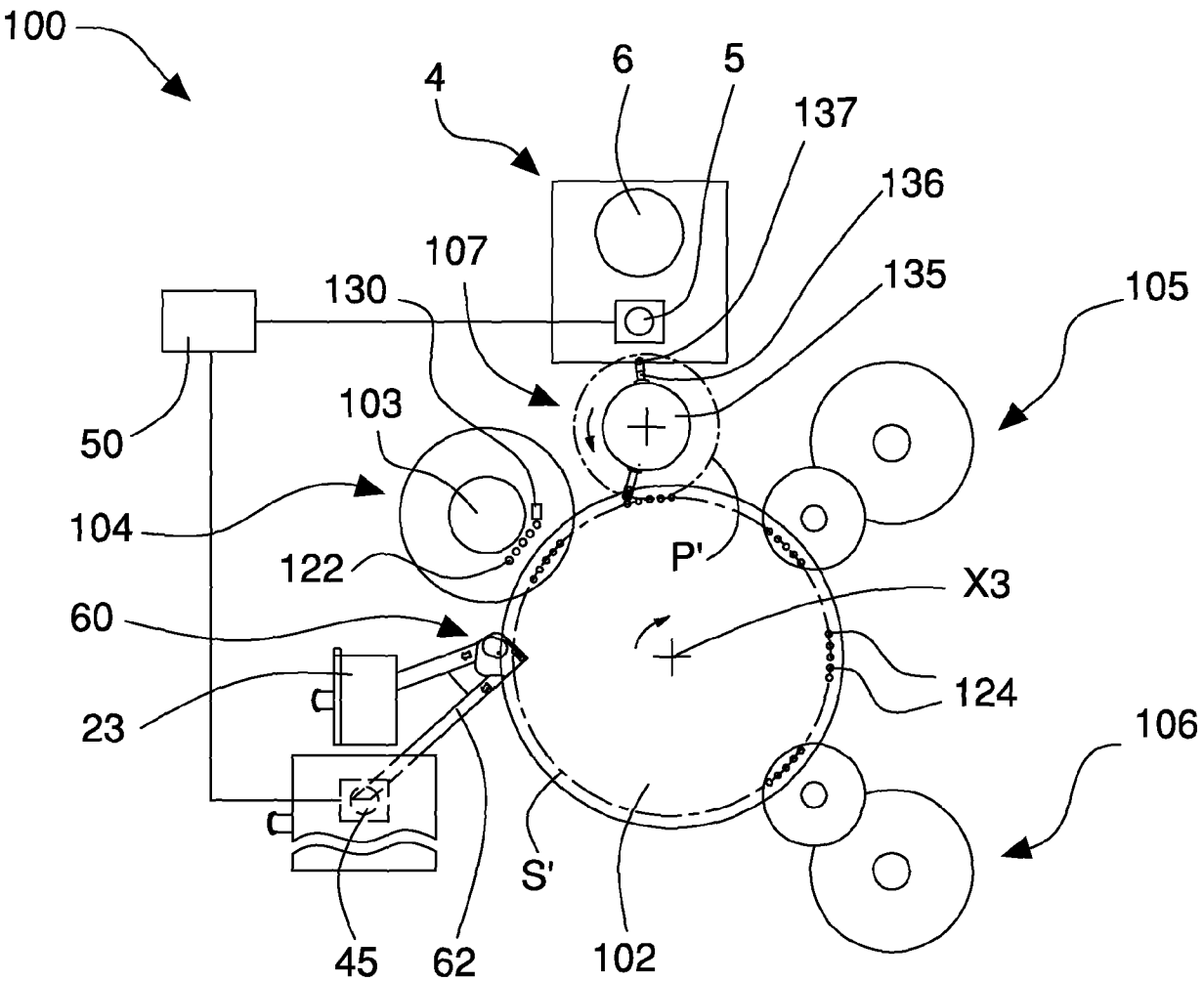
FIG. 8 is a schematic plan view of another embodiment of the machine for filling capsules according to the invention.

With reference to FIG. 8, there is provided another embodiment of the filling machine 100 that differs from the embodiment disclosed above through the fact that it comprises a turret arrangement including a single central turret 102, a feeding station 104 of the capsules and one or more filling stations 105, 106 for filling the capsules 200, 201 with product, the feeding station 104 and the filling stations 105, 106 being positioned adjacent to and on the periphery of said central turret 102. The latter is rotatable with reciprocating motion about a vertical axis X3 and has seats 124 for receiving the capsules 200, 201.

The transfer arrangement 107 is interposed between the feeding station 104 and the first filling station 105 in such a manner as to insert further capsules 201, received from the adjacent feeding unit 4, in predefined seats 124 of the central turret 102.

The separation element 60 is adjacent to the central turret 102 and downstream of the second filling station 106 for receiving the filled capsules 200 and filled further capsules 201, both of which are taken out from the central turret 2, and for conveying them respectively to the collection store 23 and to the second weighing device 45.

The operation of this embodiment of the filling machine 100 is substantially similar to that of the previously disclosed embodiment, with some differences that are illustrated below. During operation of the machine 100, the central turret 102, once has received the empty capsules 200 from the feeding station 104, orients and opens the empty capsules 200 and displaces the empty capsules 200 in succession at the filling stations 105, 106.

The feeding station 104 is provided with a plurality of feeding channels for feeding with capsules 200, drawn from the first store 103, the seats 124 of the central turret 102 during reciprocating motion dwell times. A stop arrangement, which is substantially identical to that disclosed above, is provided for blocking the descent of the capsules 200 along the feeding ducts to prevent capsules 200 from being inserted into the predefined seats 124 of the central turret 102.

In particular, by operating abutting elements of the stop arrangement of the feeding station 104 according to a fixed sequence, or a random selection, it is possible to block the descent of capsules 200 along the feeding ducts and obtain on the central turret 102 empty seats 124 in which the transfer arrangement 7 can insert respective further capsules 201 fed by the feeding unit 4.

Unlike what occurs in the filling machine 1 with a turret 2 rotating with continuous motion, the reciprocating motion of this embodiment of the machine enables the further capsules 201 to be transferred from the feeding unit 4 to the seats 124 of the central turret 102 during the reciprocating motion dwell times. In this case, it is not necessary for the trajectory of the housing 137 of the arm 136 of the transfer arrangement 107 to be overlapped for an arched portion to the circular trajectory of the seats 124, overlapping in one point being sufficient, at which, in a dwell time, transferring of the further capsules 201 occurs. In this case the trajectory P' of the housing 137 is circular and tangential to the trajectory S' of the seats 124 and the arm 136 is fixed to the transfer wheel 135.

The invention claimed is:

1. A machine for dosing a product in capsules, or similar elements, comprising a first store, a second store, a rotating turret arrangement which has seats suitable for receiving empty capsules from said first store and a dosing device for dosing the product in the capsules, the machine further comprising:

a feeding unit having a first weighing device, for weighing further empty capsules from said second store;

a transfer arrangement for transferring the further empty capsules, when weighed, to predetermined seats of the turret arrangement for being filled with the product;

a second weighing device for weighing the further capsules filled with the product and taken out from the turret arrangement; and a processing device connected to the first weighing device and to the second weighing device for receiving data relative to weights measured by means of the first and second weighing devices and for calculating for each further capsule a difference between a weight measured before and a weight measured after filling, in such manner as to calculate a respective quantity of dosed product.

2. A machine according to claim 1, wherein said turret arrangement comprises a single turret rotating about a rotation axis.

3. A machine according to claim 2, wherein the single turret comprises a plurality of working stations, each station having a respective dosing device and configured for opening, dosing the product, and closing respective capsules and further capsules during rotation of the single turret.

4. A machine according to claim 2, comprising a feeding station, provided with said first store, and at least one filling station provided with said dosing device for dosing the product, the feeding station and the at least one filling station being positioned adjacent and peripherally to the single turret.

5. A machine according to claim 1, wherein said feeding unit comprises a handling device for singly handling said further capsules from said second store to the second weighing device and from the latter to the transfer arrangement.

6. A machine according to claim 5, wherein the feeding unit comprises a first selection member for selectively conveying a further capsule which is dosed and/or within an acceptable weight tolerance to the transfer arrangement, or a further capsule which is damaged and/or outside an acceptable weight tolerance to a first rejection store.

7. A machine according to claim 1, wherein the transfer arrangement comprises a wheel rotating about a further rotation axis and containing an arm having a housing at a free end suitable for receiving a further capsule from the feeding unit and for releasing it to a defined seat of the turret arrangement.

8. A machine according to claim 7, wherein said arm is mounted axially movable on the wheel and suitable to be operated towards or away from the further rotation axis depending on an angular position of the wheel, in such a way that said housing moves along a trajectory, a portion of which substantially overlaps a respective rotation trajectory of the seats.

9. A machine according to claim 1, comprising a separation element positioned adjacent to the turret arrangement for receiving the capsules and the further capsules, filled and removed from the turret arrangement, and respectively conveying said capsules to a collection store and said further capsules to the second weighing device.

10. A machine according to claim 1, comprising a second selection member positioned downstream of the second weighing device for selectively conveying further capsules which are dosed and/or within an acceptable weight tolerance towards a movement arrangement to a collection store and further capsules which are damaged and/or outside an acceptable weight tolerance to a second rejection store.

11. A machine according to claim 1, comprising a feeding duct arrangement connected to the first store for singly drawing and conveying the capsules to the seats of the turret arrangement.

12. A machine according to claim 11, comprising a stop arrangement associated with the feeding duct arrangement, and suitable for blocking a displacement of the capsules along the feeding duct arrangement in such a manner as to prevent the capsules from being inserted in predetermined seats of the turret arrangement, and thereby keeping the predetermined seats empty.

13. A machine according to claim 12, wherein the feeding duct arrangement includes a plurality of feeding ducts, said stop arrangement comprising a plurality of movable abutting elements, each of which is associated with a respective feeding duct and suitable to be independently operated between two operating positions, in such a manner as to block or allow the capsules to pass along the respective feeding duct.

14. A method for weighing a product dosed in capsules or similar elements by means of a filling machine comprising a first store, a second store, a rotating turret arrangement which has seats suitable for receiving capsules drawn empty from said first store and a dosing device for dosing the product in the capsules, comprising the steps of:

keeping predetermined seats of the turret arrangement empty;

inserting respective further capsules drawn empty from said second store and weighed by means of the first weighing device in said empty predetermined seats;

opening, dosing the product and closing said capsules and said further capsules;

weighing by means of a second weighing device the further capsules once taken out from the turret arrangement; and calculating for each further capsule a difference between a weight measured before and a weight measured after filling, in such a way as to determine a respective quantity of dosed product.

15. A method according to claim 14, wherein said keeping said predetermined seats empty step comprises preventing the capsules from being fed to the predetermined seats.

16. A method according to claim 14, and further comprising keeping the predetermined seats empty according to a fixed or random sequence.

17. A method according to claim 14, further comprising rotating the turret arrangement with a continuous motion.

18. A method according to claim 14, wherein said inserting comprises displacing said further capsules along a motion trajectory having a portion substantially overlapping a respective rotation trajectory of said seats.

* * * * *